US007748655B2

(12) United States Patent
Schmitz et al.

(10) Patent No.: US 7,748,655 B2
(45) Date of Patent: Jul. 6, 2010

(54) CRUSHER BLOCK ASSEMBLY FOR PARTICULATE SIZE REDUCTION SYSTEM

(75) Inventors: William Schmitz, Clymer, NY (US); Richard DuVerger, Danielson, CT (US); Daniel P. Smith, Spencer, MA (US); Craig Penteson, Sutton, MA (US); Qingsheng Lin, Holden, MA (US)

(73) Assignee: Riley Power, Inc., Worcester, MA (US)

( * ) Notice: Subject to any disclaimer, the term of this patent is extended or adjusted under 35 U.S.C. 154(b) by 354 days.

(21) Appl. No.: 11/818,574

(22) Filed: Jun. 15, 2007

(65) Prior Publication Data

US 2008/0308660 A1 Dec. 18, 2008

(51) Int. Cl.
*B02C 13/00* (2006.01)

(52) U.S. Cl. ..... 241/188.1; 241/286

(58) Field of Classification Search ..... 241/188.1, 241/286

See application file for complete search history.

(56) References Cited

U.S. PATENT DOCUMENTS

| | | | | |
|---|---|---|---|---|
| 850,988 | A * | 4/1907 | Williams | 241/189.1 |
| 2,185,331 | A * | 1/1940 | Conway | 241/286 |
| 4,326,674 | A | 4/1982 | Braun et al. | |
| 4,848,682 | A * | 7/1989 | Scheler | 241/190 |
| 4,903,904 | A * | 2/1990 | Steimel | 241/154 |
| 5,257,743 | A | 11/1993 | Brown, Jr. et al. | |
| 6,237,865 | B1 | 5/2001 | Luttermann et al. | |
| 6,575,303 | B1 | 6/2003 | Brock et al. | |
| 7,028,931 | B2 | 4/2006 | Lin et al. | |
| 7,240,868 | B2 | 7/2007 | Lin et al. | |

FOREIGN PATENT DOCUMENTS

| | | | |
|---|---|---|---|
| EP | 912247 | B1 | 5/1999 |
| WO | WO9739828 | A1 | 10/1997 |
| WO | WO9947263 | A1 | 9/1999 |

* cited by examiner

*Primary Examiner*—Faye Francis
(74) *Attorney, Agent, or Firm*—Edwards Angell Palmer & Dodge LLP; Joshua L. Jones; Brian R. Pollack

(57) ABSTRACT

The invention provides a crusher block assembly for a particulate size reduction system including a crusher block having an inboard face configured and adapted to cooperate with a swing hammer in a crusher chamber of a particulate size reduction system to crush particulate, and an outboard face for receiving an adjustment mechanism. The crusher block assembly also includes an adjustment mechanism joined to the outboard face on the crusher block. The adjustment mechanism is configured and adapted to adjust the position of the crusher block along a direction between an inboard location and an outboard location within the crusher chamber. The invention also provides a method of adjusting clearance between a swing hammer and a crusher block in a particulate size reduction system.

11 Claims, 8 Drawing Sheets

CRUSHER BLOCK ASSEMBLY FOR PARTICULATE SIZE REDUCTION SYSTEM

BACKGROUND OF THE INVENTION

1. Field of the Invention

The present invention relates to methods and systems for material treatment, such as particulate size reduction. Particularly, the present invention is directed to methods and systems for material size reduction that are useful in coal technology.

2. Description of Related Art

In operations that use coal for fuel, finely-ground coal particles or "fines" are required for efficient operation, yielding higher combustion efficiency than stoker firing, as well as rapid response to load changes. Using coal fines for combustion has the potential for less nitrous oxide ($NO_x$) emissions and keeps oversized loss-on-ignition (LOI) unburned coal particles from contaminating the marketable ash byproduct of the combustion chamber. Thus, it is common practice to supply raw coal to a device, such as a pulverizer, that will reduce the size of the coal to particles within a desirable size range prior to being conveyed to the furnace for combustion.

Many pulverizers employ systems and methods including one or more crushing and grinding stages for breaking up the raw coal. Coal particles are reduced by the repeated crushing action of rolling or flailing elements to dust fine enough to become airborne in an air stream swept through the pulverizer. The dust particles are entrained in the air stream and carried out for combustion.

It should be readily apparent that the process of reducing solid coal to acceptably sized fines requires equipment of high strength and durability. Therefore, there exists a continuing need for crushing and grinding components which can reduce solid coal to acceptably sized fines in less time with greater efficiency, and in a manner which results increased wear life for those components. The present invention provides a solution for these problems.

SUMMARY OF THE INVENTION

The purpose and advantages of the present invention will be set forth in and become apparent from the description that follows. Additional advantages of the invention will be realized and attained by the methods and systems particularly pointed out in the written description and claims hereof, as well as from the appended drawings.

To achieve these and other advantages and in accordance with the purpose of the invention, as embodied herein, the invention includes a crusher block assembly for a particulate size reduction system. The crusher block assembly includes a crusher block having an inboard face configured and adapted to cooperate with a swing hammer in a crusher chamber of a particulate size reduction system to crush particulate. The crusher block also has an outboard face for receiving an adjustment mechanism. An adjustment mechanism is joined to the outboard face of the crusher block. The adjustment mechanism is configured and adapted to adjust the position of the crusher block along a direction between an inboard location and an outboard location within the crusher chamber.

In accordance with a further aspect of the invention, the crusher block assembly further includes a yoke assembly joining the outboard face of the crusher block to the adjustment mechanism. The crusher block can define at least one attachment bore configured and adapted to receive a fastener for attaching the yoke to the crusher block. The at least one attachment bore can be defined in a flange extending from the outboard face of the crusher block. Two adjustable fasteners can attach the yoke to the crusher block. The crusher block assembly can further include first and second side supports, each side support being attached to a lateral side of the crusher block. The crusher block can include a material chosen from the group including cast iron, cast manganese steel, cast stainless steel, combinations thereof, and any other suitable material.

The invention also includes a particulate size reduction system including a crushing chamber and a center shaft. The center shaft defines an axis of rotation and is configured for rotational motion within the crushing chamber. A wheel assembly is mounted on the center shaft within the crushing chamber. At least one swing hammer is mounted on the wheel assembly. The swing hammer includes a first crushing face. The system further includes a crusher block assembly having a crusher block. The crusher block includes an inboard face configured and adapted to cooperate with the swing hammer in the crusher chamber to crush particulate. The crusher block also includes an outboard face for receiving an adjustment mechanism. An adjustment mechanism is joined to the outboard face of the crusher block. The adjustment mechanism is configured and adapted to adjust the position of the crusher block along a direction between an inboard location and an outboard location within the crusher chamber.

In accordance with another aspect of the invention, the adjustment mechanism is configured and adapted to be adjusted from outside the crusher chamber to adjust the position of the crusher block relative to the at least one swing hammer. A yoke assembly can join the outboard face of the crusher block to the adjustment mechanism. The crusher block can define at least one attachment bore configured and adapted to receive a fastener for attaching the yoke to the crusher block. If desired, two adjustable fasteners can attach the yoke to the crusher block. The crusher block assembly can further include first and second side supports, each side support being attached to a lateral side of the crusher block.

The invention also includes a method of adjusting clearance between a swing hammer and a crusher block in a particulate size reduction system. The method includes the step of operating a particulate size reduction system by rotating at least one swing hammer mounted on a wheel assembly about a center shaft mounted in a crushing chamber. The at least one swing hammer includes a first crushing face. The method further includes disposing an inboard face of a crusher block proximate the at least one swing hammer and advancing the crusher block assembly toward the at least one swing hammer by adjusting an adjustment mechanism joined to the outboard face of the crusher block until the crusher block begins to contact the at least one rotating swing hammer. The method also includes retracting the crusher block away from the at least one swing hammer using the adjustment mechanism to a predetermined distance.

In accordance with another aspect of the invention, the predetermined distance may be between about one eighth of an inch and about three eighths of an inch. The predetermined distance is preferably about one quarter of an inch. Moreover, the adjustment mechanism can include two laterally displaced adjustable fasteners connected to the outboard face of the crusher block, wherein the relative adjustment of one of the laterally displaced fasteners moves a first edge of the crusher block closer to the swing hammer than a second edge of the crusher block.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

DETAILED DESCRIPTION OF THE PREFERRED EMBODIMENT

Reference is now made to the figures and accompanying detailed description which have been provided to illustrate exemplary embodiments of the present invention, but are not intended to limit the scope of embodiments of the present invention. Although a particular type of rotary coal pulverizer is shown in the figures and discussed herein, it should be readily apparent that a device or system constructed in accordance with the present invention can be employed in a variety of other particulate size reduction systems, or other applications that do not involve coal as the raw material. In other words, the specific material and size reduction process is not vital to gaining the benefits associated with using a system constructed in accordance with the present invention.

Figure 1:
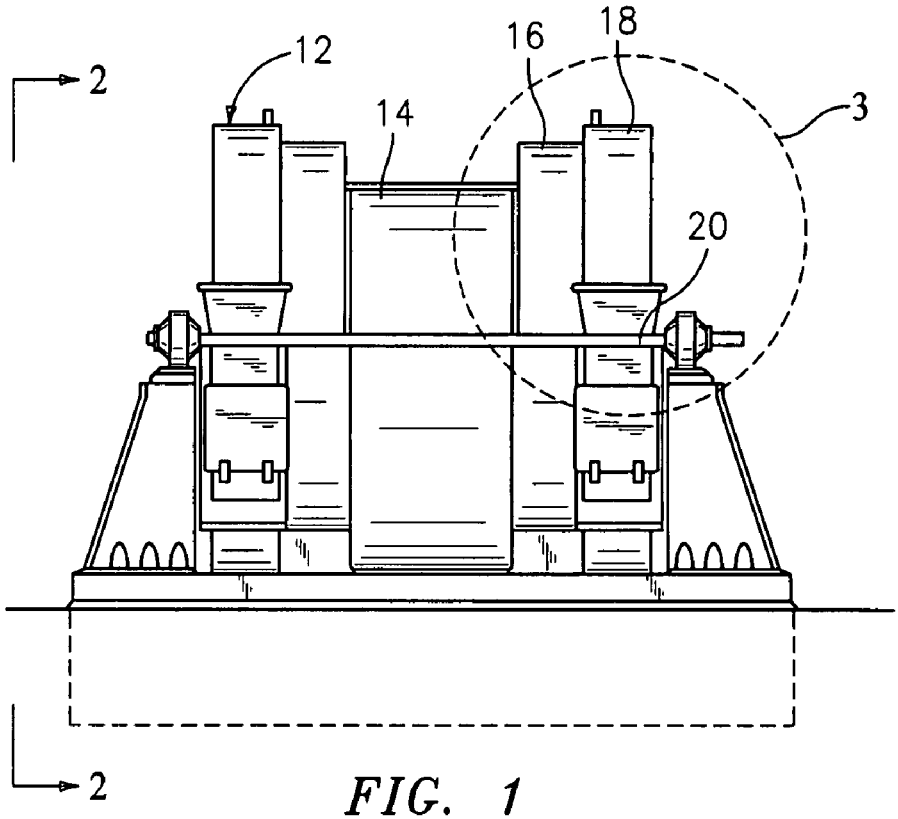
FIG. 1 is a front view of an exemplary rotary coal pulverizer (duplex model) which can employ a crusher block assembly constructed in accordance with the present invention therein mounted on the center shaft at two locations.
Figure 2:
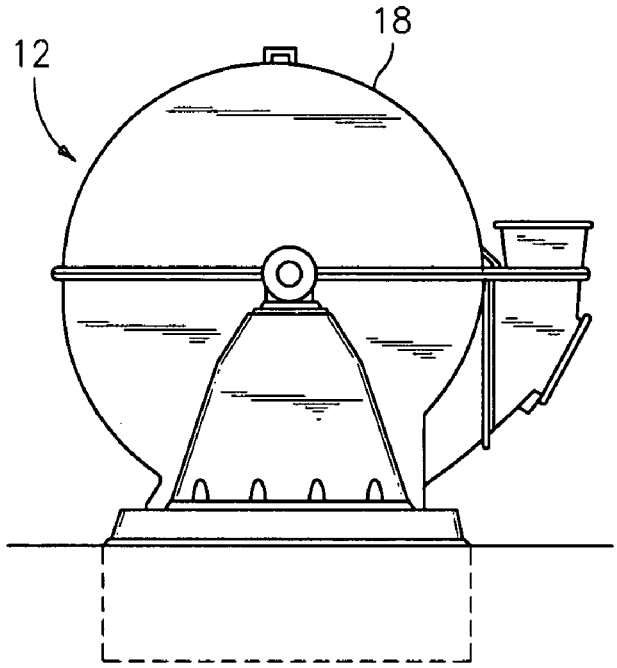
FIG. 2 is a side view of the rotary coal pulverizer of FIG. 1, illustrating the output from the fan section of the pulverizer.

FIGS. 1 and 2 illustrate the general location of a presently preferred embodiment of a crusher block assembly constructed in accordance with the present invention employed in an exemplary rotary coal pulverizer 12. Pulverizer 12 is known as a horizontal type high speed coal mill and is closely based on a duplex model ATRITA® pulverizer sold commercially by Babcock Power Inc. However, this should not be interpreted as limiting the present invention in any way, as many types of particulate size reduction systems employ similar elements and are suitable for use with the present invention.

The duplex model is essentially two single models side by side. It should be readily apparent that a crusher block assembly constructed in accordance with the present invention may also be disposed in a single model. For purposes of ease and convenience in describing the features of the present invention, only a single side of the duplex model is discussed herein.

Figure 3:
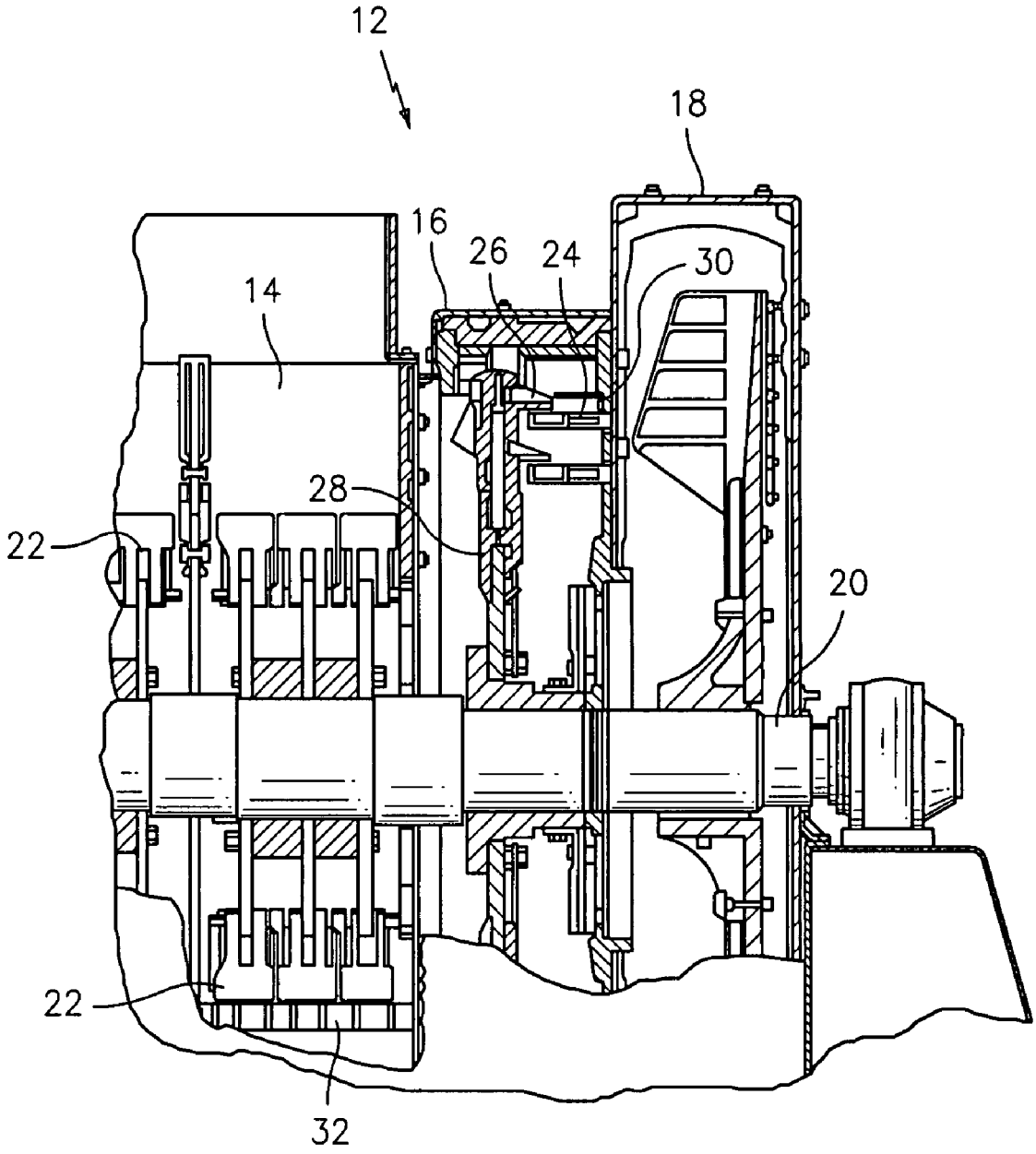
FIG. 3 is an enlarged localized partial cross-sectional view of a portion of the exemplary rotary coal pulverizer of FIG. 1, illustrating the grid cooperating with the swing hammers in the grinding section.

As can be seen in FIG. 3, pulverizer 12 consists essentially of a crusher-dryer section 14, a grinding section 16 and a fan section 18. A center shaft 20 extends through the pulverizer 12 and defines an axis of rotation. Thus, terms used herein, such as "radially outer" and "radially inner," therefore refer to the relative distance in a perpendicular direction from the axis defined by center shaft 20, while "axially inner" and "axially outer" refer to the distance along or parallel to the axis defined by center shaft 20, wherein the "axially innermost" section in pulverizer 12 is crusher-dryer section 14.

With continuing reference to FIG. 3, raw coal and primary air enter the crusher-dryer section 14. Swing hammers 22 mounted on a wheel assembly that is driven by center shaft 20, along with impact liners (not shown), operate to crush the coal against a grid 32. High temperature primary air is used to flash dry any surface moisture on the coal, which helps minimize the effect of moisture on coal capacity, coal fineness, and power consumption, among other things. As the high-temperature primary air evaporates moisture from the coal, the temperature of the coal-air mixture is reduced, which significantly reduces the risk of fires within the pulverizer.

When coal passes through the grid of the crusher-dryer section 14, it enters the axially outer adjacent grinding section 16. The major grinding components in grinding section 16 include stationary pegs 24 and grinding clips 26 disposed on a rotating wheel assembly 28 mounted on center shaft 20. Pegs 24 are arranged on interior grinding section wall 30 in spaced apart relationships with respect to each other. Furthermore, pegs 24 are perpendicular with respect to wall 30, and opposed to clips 26, but are spaced so that clips 26 and pegs 24 do not contact each other during rotation of wheel assembly 28.

Wheel 28 is driven by center shaft 20, preferably at a relatively high rate of speed. The turbulent flow and impact momentum on particles, caused by the movement of clips 26 and pegs 24, create a particle-to-particle attrition, which further reduces the size of the coal particles received from crusher-dryer section 14. Coal particles ground to an acceptably small size then pass from grinding section 16 and into fan section 18, where the coal fines are entrained into a flow out of pulverizer 12 for use in other processes, such as combustion.

Figure 4:
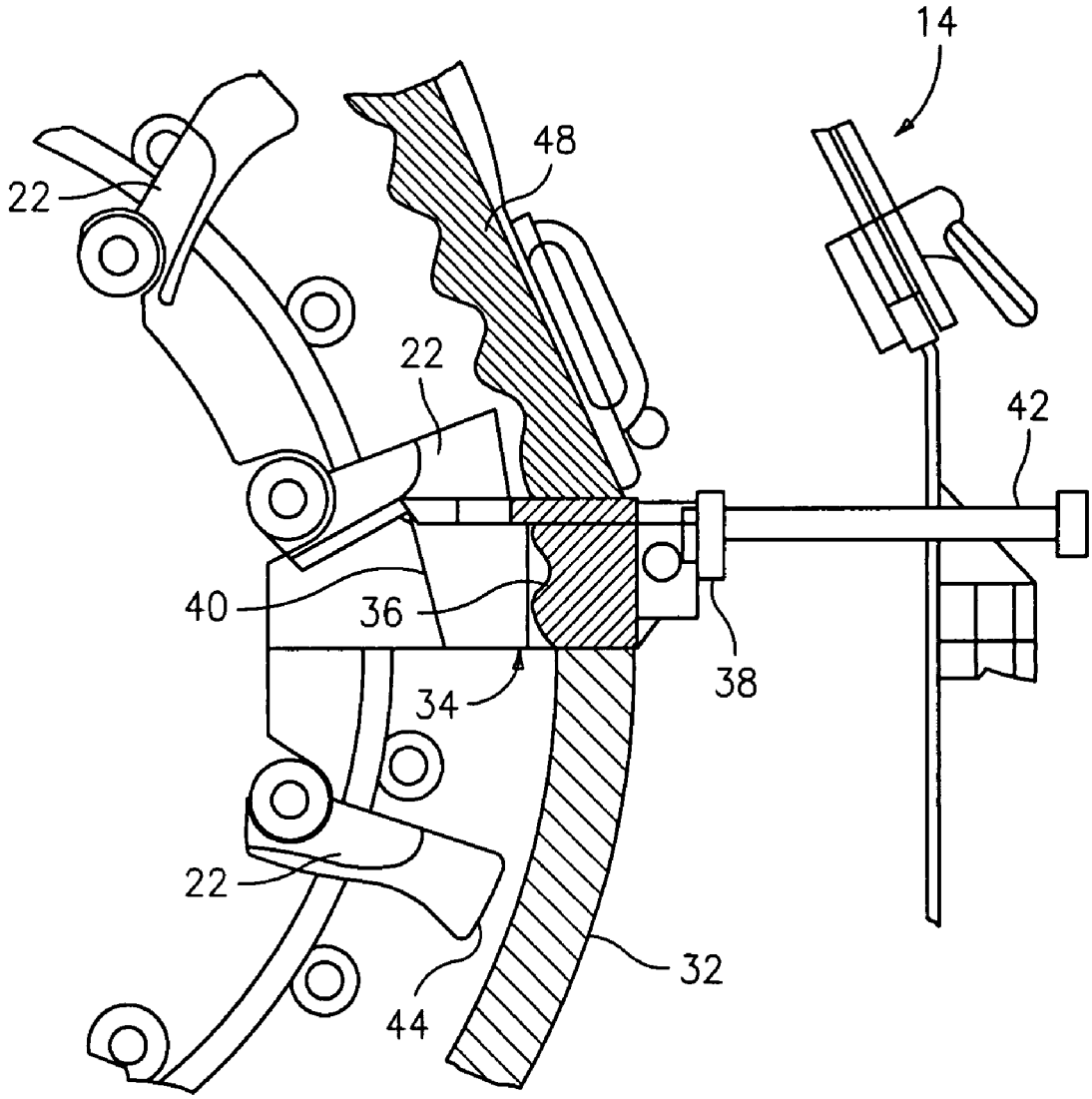
FIG. 4 (PRIOR ART)
FIG. 4 is a side cross-sectional view of a portion of the crushing chamber of FIG. 1, showing the relationship between an exemplary prior art crusher block assembly and a plurality of swing hammers rotatable about the center shaft.

FIG. 4 shows a portion of crusher-drier section 14 in detail. Relatively large coal particles enter pulverizer 12 through the top portion of crusher-drier section 14. Large particles are crushed between rotating swing hammers 22 and stationary breaker plate 48. Coal particles that have been broken down to a size typically around ¼ inch (6.35 mm) pass through grid 32 into an area between grid 32 and the outer housing of crusher-drier section 14. From there, coal particles are conveyed into grinding section 16, as described above.

With continued reference to FIG. 4, prior art crusher block assembly 34 is disposed between breaker plate 48 and grid 32. During operation over a period of time, the grinding surfaces of breaker plate 48, swing hammers 22, and crusher block assembly 34 wear down. The wear increases the gaps between the grinding faces of swing hammers 22 and the grinding surfaces of breaker plate 48 and crusher block assembly 34, making it more difficult to reduce coal particles down to the desired size for passage through grid 32. Therefore, crusher block assembly 34 is connected to an adjustment mechanism 42 which can be used to move crusher block assembly 34 closer and closer to rotating swing hammers 22 to maintain the desired clearance as the grinding face 36 of crusher block assembly 34 wears down.

Figure 5A:
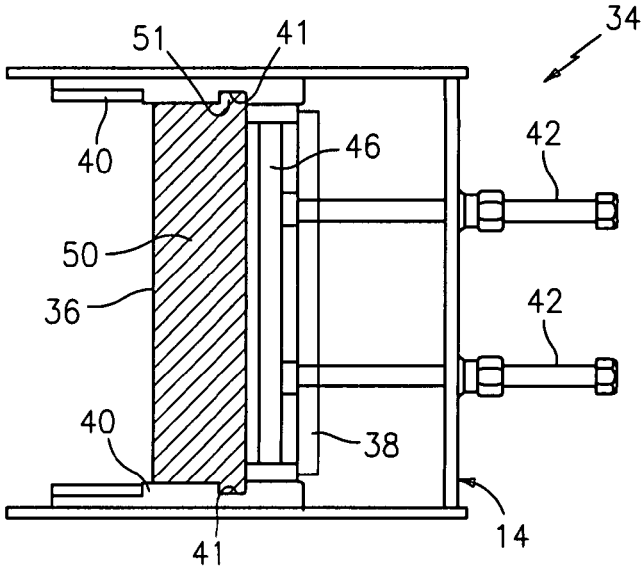
FIG. 5a (PRIOR ART)
FIG. 5*a* is a top view of an exemplary prior art crusher block assembly, showing the adjustment mechanism attached to a yoke assembly, which is connected to the side supports, which in turn connect the crusher block to the assembly.
Figure 5B:
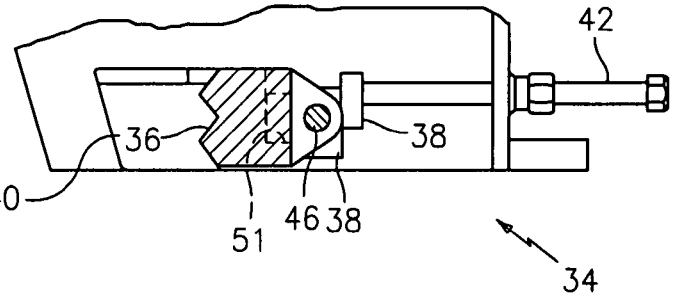
FIG. 5b (PRIOR ART)
FIG. 5*b* is a side elevation view of the exemplary prior art crusher block assembly of FIG. 5*a*, showing the adjustment mechanism attached to a yoke assembly, which is connected to the side supports, which in turn connect the crusher block to the assembly.

However, adjusting prior art crusher block assembly 34 is problematic. As shown in FIGS. 5*a*-5*b*, adjustment mechanism 42 includes two pins or bolts extending through the outer housing of crusher-drier section 14, and attaching to prior art yoke assembly 38. Ideally, prior art yoke assembly 38 can be shifted back and forth parallel to the bolts/pins by rotating the bolts/pins of adjustment mechanism 42. Yoke assembly 38 holds rod 46, which extends into a side support 40 on either lateral end of crusher block assembly 34. Recesses 41 defined in each side support receives a tab 51 of crusher block 50. Thus, when the adjustment mechanism 42 is advanced, force is transmitted to the crusher block 50 by way of the connection established between the tabs 51 and recesses 41.

However, in practice it has been shown that suitable control of movement of the crusher block 50 is problematic if not impossible. Specifically, it has been discovered by Applicants that merely having tabs 51 rest in recesses 41 of the side supports 40 does not provide the tolerance required to effectively control the movement of crusher block 50 during operation of the system.

Specifically, the adjustment mechanism 42 is advanced to move the crusher block 50 in an inboard direction toward the operating swing hammers until contact is established between the two components. The operator hears a "ticking" sound at this point. The operator then attempts to "back off" the crusher block to an acceptable distance from the moving swing hammers, leaving, for example a quarter inch gap, and, to stop the "ticking." To stop the ticking, however, it is possible that the operator backs out the crusher block a greater distance than desired due to the manufacturing tolerances between the recesses in the side supports and the crusher block being too great, tending to cause some "lag" in the crusher block 50 following the side supports 40 in the outboard direction. A larger gap results in decreased pulverizer output, and may also result in the crusher block being "cock-eyed" so that an uneven gap is defined between the swing hammer and crusher block, causing uneven wear of the swing hammer, as well as the crusher block. Notably, if the operator fails to carefully advance the crusher block toward the operating swing hammers, the operator runs the risk of interfering with the hammers' forward motion which can then result in hammer breakage, and possibly further damage.

The tolerance problem mentioned above cannot be improved, mainly because the crusher block 50 must be made from an extremely hard material to withstand wear that is extraordinarily difficult to machine after it has been cast. Thus, this excessive tolerance cannot be remedied in this prior art configuration. Thus, in practice, adjustment of assembly 34 easily results in binding of the parts, jumping of the assembly between breaker plate 48 and grid 32, non-uniform wear on inboard face 36, and overall reduced wear life for assembly 34, and reduced performance of the pulverizer.

In contrast, FIGS. 6*a*-8 illustrate a crusher block assembly 134, or aspects thereof, constructed in accordance with the present invention, which reduces or eliminates the adjustment problems described above resulting from tolerancing problems. Crusher block 50 has an inboard face 136 for cooperating with swing hammers 22, and an outboard face opposite inboard face 136 for attaching to adjustment mechanism 142. FIG. 7*a*-7*b* show crusher block 150 in isolation. Flange 152 extends from crusher block 150 opposite inboard face 136. Two bores 154 extend through flange 152 and are dimensioned to accommodate a fastener, such as a typical bolt. Recess 158 (See FIG. 7*a*) accommodates tools used to install a fastener. Tabs 156 allow for connection to corresponding slots in side supports 140.

Figure 6A:
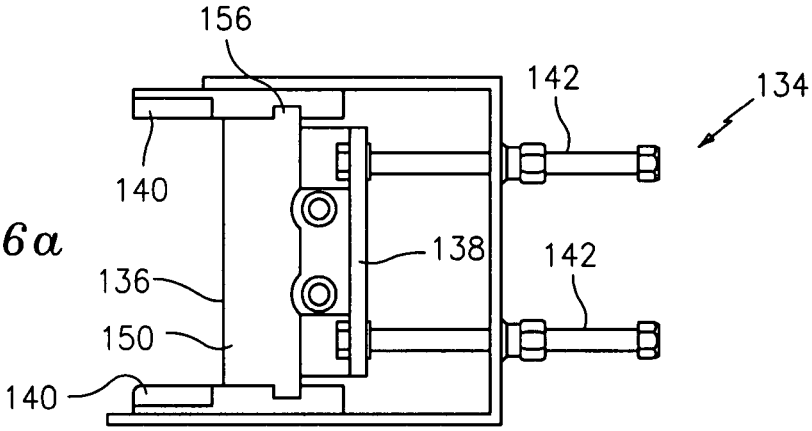
FIG. 6*a* is a top view of a first representative embodiment of a crusher block assembly in accordance with the present invention, showing an adjustment mechanism connected to a yoke assembly, which is joined directly to a crusher block.
Figure 6B:
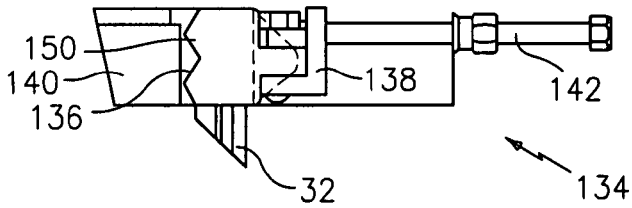
FIG. 6*b* is a side elevation view of the crusher block assembly of FIG. 6*a* in accordance with the present invention, showing an adjustment mechanism connected to a yoke assembly, which is joined directly to a crusher block, and also showing the grid.
Figure 7A:
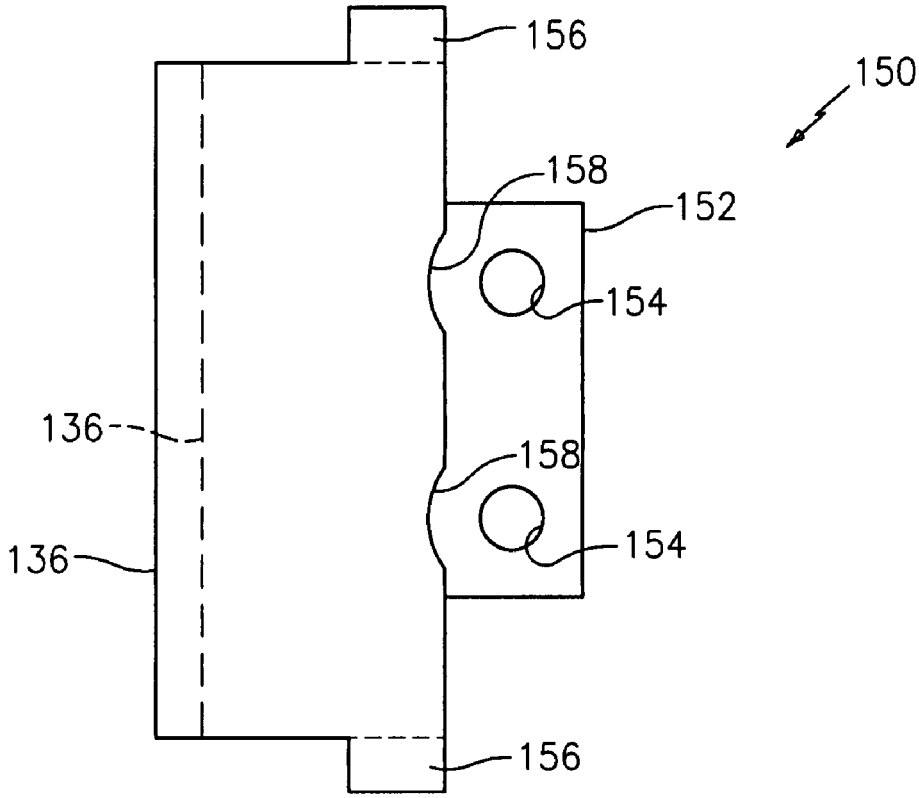
FIG. 7*a* is a top view of a crusher block of the crusher block assembly of FIG. 6*a* in accordance with the present invention, showing the flange with a pair of bores for attachment with the yoke assembly, as well as the pair of tabs on the lateral sides for attachment to the side supports.
Figure 7B:
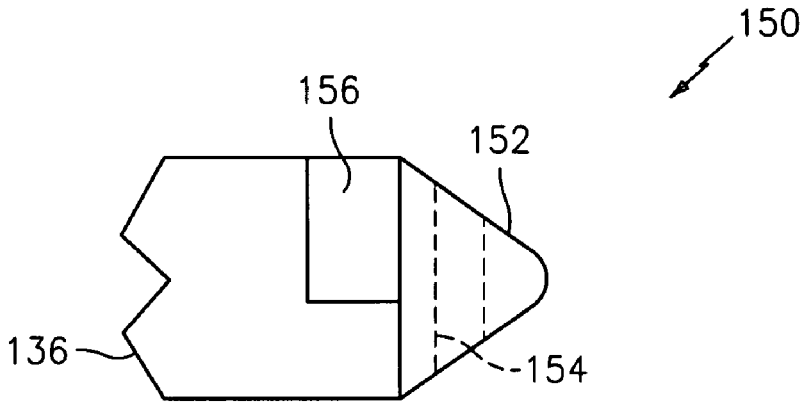
FIG. 7*b* is a side elevation view of the crusher block of FIG. 7*a* in accordance with the present invention, showing the elevation of the flange and bore, as well as the inboard face for cooperating with the swing hammers.

As best seen in FIGS. 6*a*-6*b*, adjustment mechanism 142 connects to yoke assembly 138. Yoke assembly 138 is joined directly to crusher block 150 by a pair of bolts extending through bores 154 in flange 152. Side supports 140 are attached to crusher block 150 by tabs 156. Side supports 140 serve as a mechanical stop and as a guide for adjusting the crusher block assembly 134. The side supports 140 rest on the grid and are further guided by the upper housing side wear plates (not depicted).

Figure 9A:
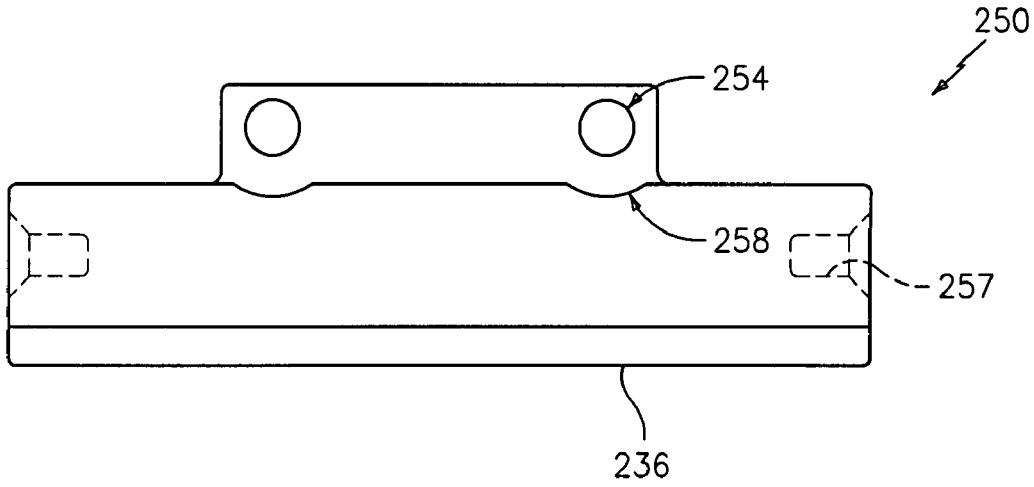
FIG. 9*a* is a top view of another exemplary embodiment of a crusher block constructed in accordance with the present invention, showing slots on its sides in hidden lines.
Figure 9B:
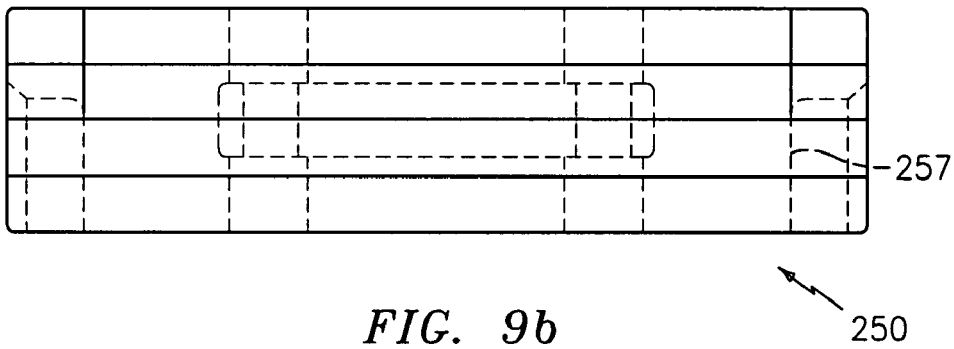
FIG. 9*b* is a front elevation view of the crusher block of FIG. 9*b*, showing the inboard face with the slots on the sides of the crusher block in hidden lines.
Figure 9C:
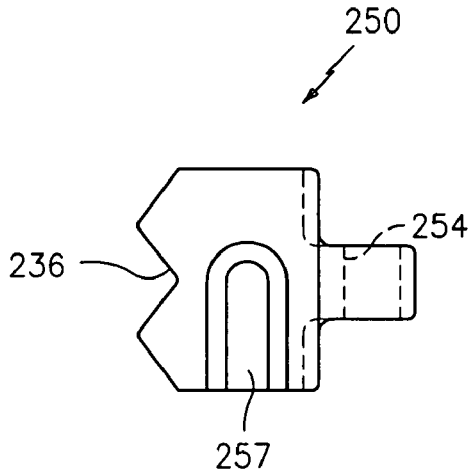
FIG. 9*c* is a side elevation view of the crusher block of FIG. 9*a* of the present invention showing one of the slots.
Figure 10B:
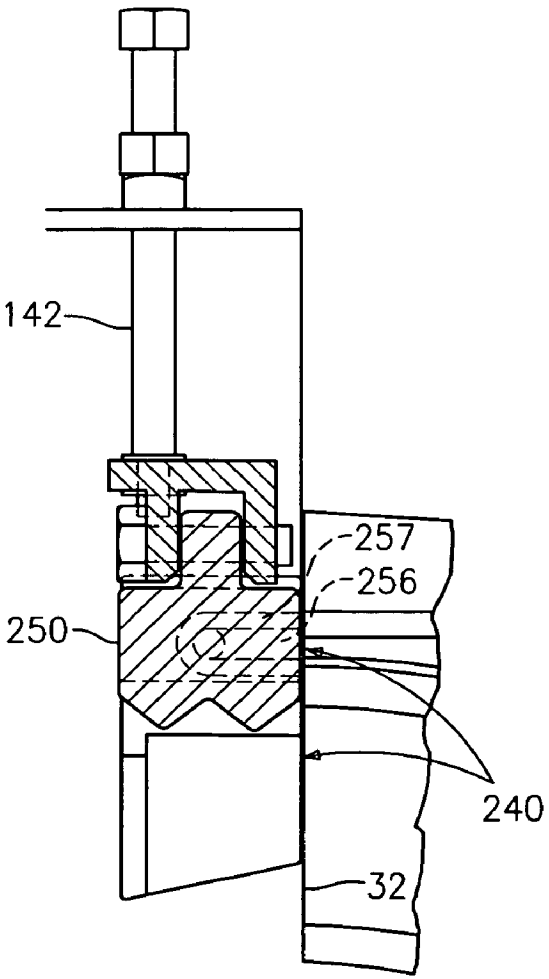
FIG. 10*b* is a cross-sectional side elevation view of the crusher block of FIG. 9*a*, showing one of the slots in the crusher block accommodating a tab of the respective side support.
Figure 10A:
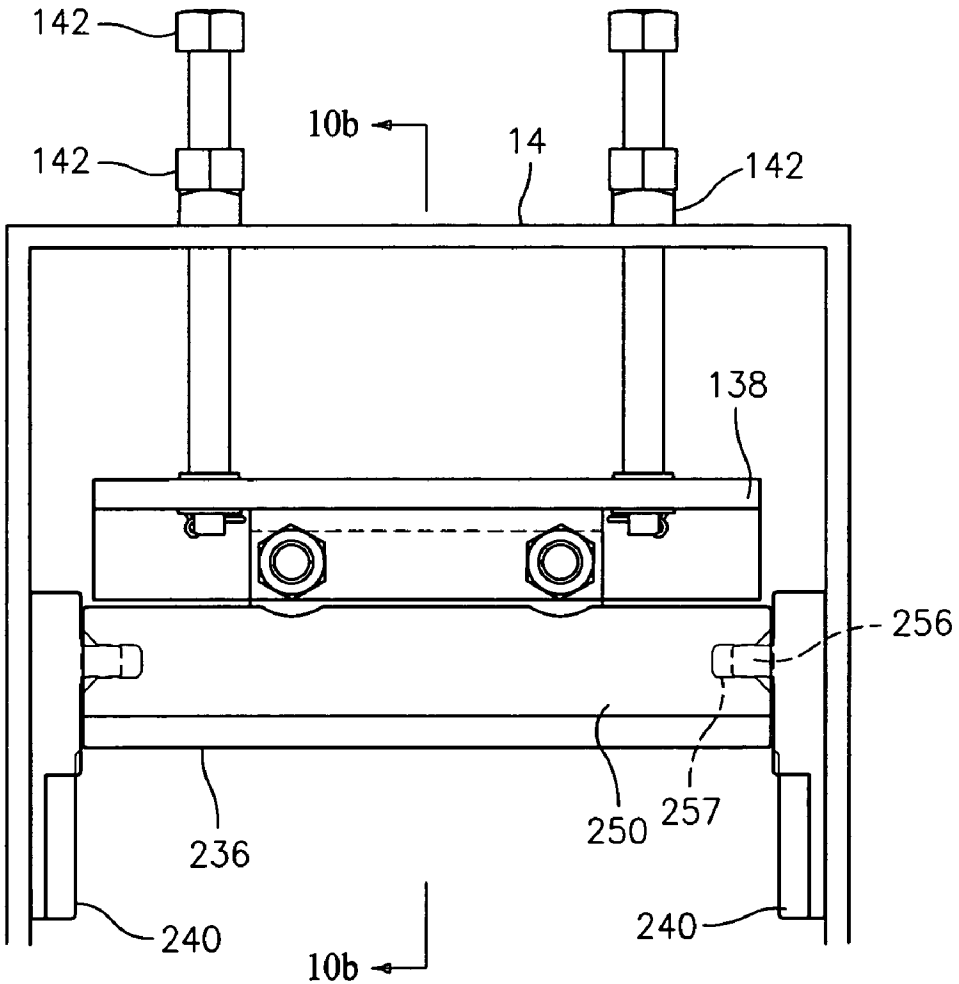
FIG. 10*a* is a top view of the crusher block of FIG. 9*a*, showing the slots in the crusher block accommodating the respective tabs of the side supports.

It is also possible for the side supports to have tabs that are received in the crusher block. FIGS. 9*a*-9*c* show crusher block 250 with slots 257 on its sides. Also shown are inboard face 236, bores 254, and recess 258. Slots 257 accommodate tabs 256 of side supports 240, as depicted in FIGS. 10*a* and 10*b*. Slots 257 and tabs 256 are configured to tolerate slight degrees of misalignment between the housing walls (e.g. 14) that can be present particularly in pulverizers that have been in service for several years. The configuration shown in FIGS. 9*a*-10*b* thus allows for installation of new crusher block assemblies in older machines as well as newer machines.

In this configuration, those skilled in the art will readily appreciate that there is very little play between adjustment mechanism 142 and crusher block 150. This is due largely to the direct, positive connection between yoke assembly 138 and crusher block 150, as opposed to the circuitous connection in prior art assembly 34 in which yoke assembly 38 connects indirectly to crusher block 50 through rod 46 and side supports 40 (which can be seen by comparing FIGS. 5*a*-5*b* with FIGS. 6*a*-6*b*). In practice, this crusher block 150 has been found to be very responsive to adjustments of adjustment mechanism 142, reducing or eliminating the problems of binding, non-uniform wear (because inboard face 136 can be kept parallel to swing hammers 22), jumping, and short wear life in prior art assembly 34. Assembly 134 gives far greater control over the precise clearance between swing hammers 22 and inboard face 136 than is possible with prior art assembly 34.

Crusher block 150 can be made from a variety of materials including cast iron, cast manganese steel, cast stainless steel, combinations of the foregoing materials, or any other suitable material. Cast stainless steel is a particularly advantageous material for use with coal having high sulfur content. Those skilled in the art will readily appreciate that the invention can be practiced with two bolts in two bores 154, or with more or less bolts/bores without departing from the spirit and scope of the invention. Moreover, while crusher block 150 has a single flange 152 with bores 154, it is possible to use a separate flange for each bore. Similarly, while crusher block assembly 134 has been described above using bolts in bores 154 to connect yoke assembly 138 to crusher block 150, any suitable fasteners or joining method can be used without departing from the spirit and scope of the invention.

In accordance with another aspect of the invention, a method is provided for adjusting clearance between a swing hammer and a crusher block in a particulate size reduction system. The method includes the steps of operating a particulate size reduction system by rotating at least one swing hammer mounted on a wheel assembly about a center shaft mounted in a crushing chamber. The at least one swing hammer includes a first crushing face. The method further includes disposing an inboard face of a crusher block proximate the at least one swing hammer and advancing the crusher block assembly toward the at least one swing hammer by adjusting an adjustment mechanism joined to the outboard face of the crusher block until the crusher block begins to contact the at least one rotating swing hammer. The method also includes retracting the crusher block assembly away from the at least one swing hammer using the adjustment mechanism to a predetermined distance.

Figure 8:
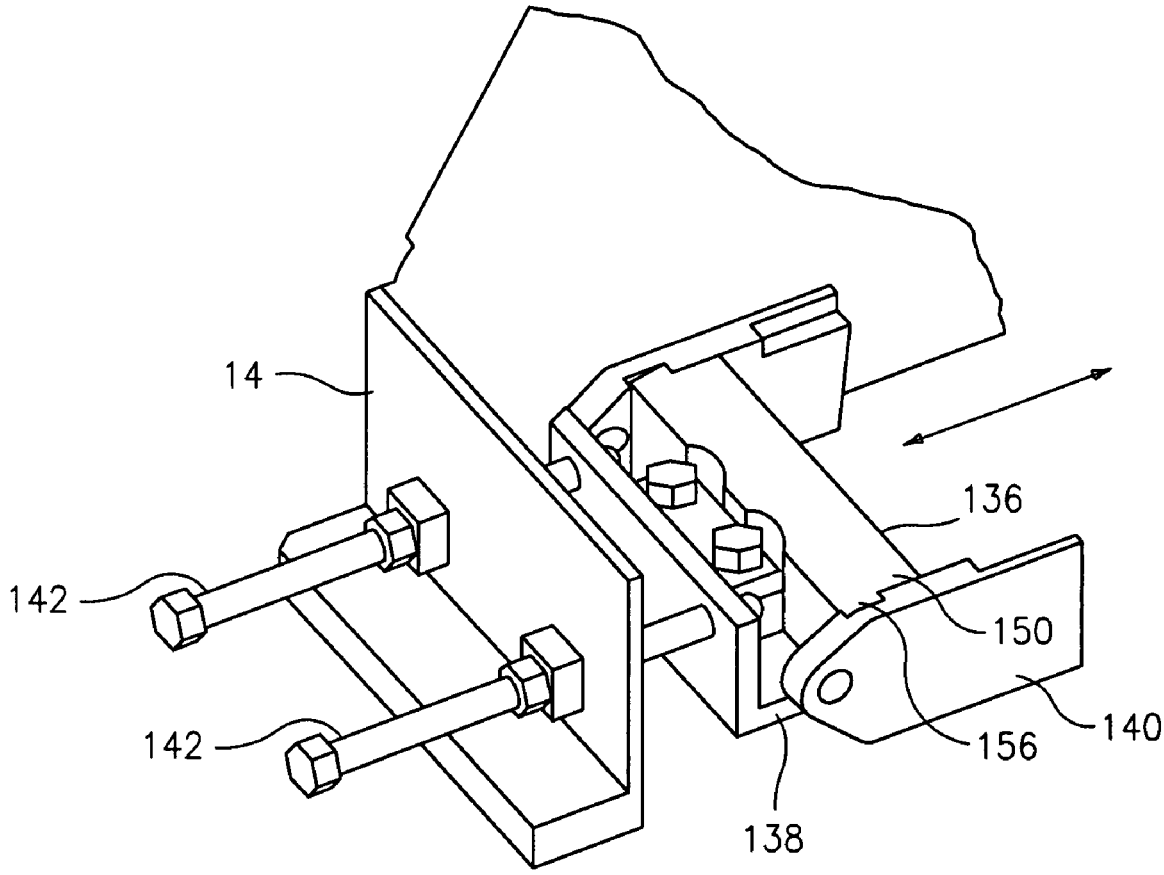
FIG. 8 is a perspective view of a the crusher block assembly of FIG. 6*a* in accordance with the present invention, showing the direction of motion during adjustment of the crusher block assembly.

For purposes of illustration and not limitation, as embodied herein and as depicted in FIG. 8, a particulate size reduction system (e.g. pulverizer 12) is operated by rotating at least one swing hammer (e.g. 22) mounted on a wheel assembly about a center shaft (e.g. 20) mounted in a crushing chamber (e.g. 14). An inboard face of (e.g. 136) of a crusher block (e.g. 150) is disposed proximate the swing hammer. The at least one swing hammer has a first crushing face for cooperating with the inboard face of the crusher block to crush particles such as coal particles. According to the method, the crusher block assembly is advanced toward the at least one swing hammer by adjusting an adjustment mechanism (e.g. 142) joined to the outboard face of the crusher block until the crusher block begins to contact the at least one rotating swing hammer. Generally contact between the crusher block and the swing hammer(s) will be evidenced by a loud clanking sound and/or vibrations, assuming the swing hammer(s) are rotating past the crusher block. At this point, the crusher block assembly is retracted away from the at least one swing hammer to a predetermined distance using the adjustment mechanism. The large arrow in FIG. 8 shows the general direction of motion in the crusher block assembly as it is advanced and retracted during adjustment.

In further accordance with the invention, the predetermined distance can be between about one eighth of an inch to about three eights of an inch. Preferably, the predetermined distance is about one quarter of an inch, however those skilled in the art will readily appreciate that the predetermined distance can be any distance suitable to produce the desired amount of particle size reduction. Moreover, the adjustment mechanism can include two laterally displaced adjustable fasteners connected to the outboard face of the crusher block so that relative adjustment of one of the laterally displaced fasteners moves a first edge of the crusher block closer to the swing hammer than a second edge of the crusher block.

The methods and systems of the present invention, as described above and shown in the drawings, provide for a crusher block assembly with superior properties including the ability to allow very precise adjustments responsive to wear inside the crusher-drier section of a pulverizer. It will be apparent to those skilled in the art that various modifications and variations can be made in the device and method of the present invention without departing from the spirit or scope of the invention. Thus, it is intended that the present invention include modifications and variations that are within the scope of the appended claims and their equivalents.

What is claimed is:

1. A crusher block assembly for a particulate size reduction system comprising:

a) a crusher block having i) an inboard face configured and adapted to cooperate with a swing hammer in a crusher chamber of a particulate size reduction system to crush particulate; and ii) an outboard face for receiving an adjustment mechanism;

b) an adjustment mechanism operatively joined to the outboard face of the crusher block, the adjustment mechanism being configured and adapted to adjust the position of the crusher block along a direction between an inboard location and an outboard location within the crusher chamber; and c) a yoke assembly joining the outboard face of the crusher block to the adjustment mechanism, wherein the yoke assembly is joined directly to the crusher block and to the adjustment mechanism.

2. A crusher block assembly as recited in claim 1, wherein the crusher block defines at least one attachment bore configured and adapted to receive a fastener for attaching the yoke to the crusher block.

3. A crusher block assembly as recited in claim 2, wherein the at least one attachment bore is defined in a flange extending from the outboard face of the crusher block.

4. A crusher block assembly as recited in claim 3, wherein two adjustable fasteners attach the yoke to the crusher block.

5. A crusher block assembly as recited in claim 4, further comprising first and second side supports, each side support being attached to a lateral side of the crusher block.

6. A crusher block assembly as recited in claim 5, wherein the crusher block includes a material chosen from the group consisting of cast iron, cast manganese steel, cast stainless steel, and combinations thereof.

7. A particulate size reduction system comprising:

a) a crushing chamber;

b) a center shaft defining an axis of rotation and configured for rotational motion within the crushing chamber;

c) a wheel assembly mounted on the center shaft within the crushing chamber;

d) at least one swing hammer mounted on the wheel assembly, the at least one swing hammer including a crushing face; and e) a crusher block assembly including:

i) a crusher block having:

(1) an inboard face configured and adapted to cooperate with the crushing face of the swing hammer in the crusher chamber to crush particulate; and (2) an outboard face for receiving an adjustment mechanism;

ii)an adjustment mechanism operatively joined to the outboard face of the crusher block, the adjustment mechanism being configured and adapted to adjust the position of the crusher block along a direction between an inboard location and an outboard location within the crusher chamber; and iii) a yoke assembly joining the outboard face of the crusher block to the adjustment mechanism, wherein the yoke assembly is joined directly to the crusher block and to the adjustment mechanism.

8. A particulate size reduction system as recited in claim 7, wherein the adjustment mechanism is configured and adapted to be adjusted from outside the crusher chamber to adjust the position of the crusher block relative to the at least one swing hammer.

9. A particulate size reduction system as recited in claim 7, wherein the crusher block defines at least one attachment bore configured and adapted to receive a fastener for attaching the yoke to the crusher block.

10. A particulate size reduction system as recited in claim 9, wherein two adjustable fasteners attach the yoke to the crusher block.

11. A particulate size reduction system as recited in claim 7, wherein the crusher block assembly further includes first and second side supports, each side support being attached to a lateral side of the crusher block.

* * * * *